US005709444A

United States Patent [19]

Fitz et al.

[11] Patent Number: 5,709,444

[45] Date of Patent: Jan. 20, 1998

[54] DRAWER

[75] Inventors: Helmut Fitz, Lustenau; Edgar Huber, Hard, both of Austria

[73] Assignee: Julius Blum Gesellschaft m.b.H., Höchst, Austria

[21] Appl. No.: 500,591

[22] Filed: Jul. 11, 1995

[30] Foreign Application Priority Data

Jul. 11, 1994 [AT] Austria ..... 1362/94

[51] Int. Cl.[6] ..... A47B 88/14

[52] U.S. Cl. ..... 312/348.2; 312/348.1; 312/330.1; 312/334.6; 312/334.12; 312/334.32

[58] Field of Search ..... 312/348.2, 348.1, 312/334.1, 334.6, 334.8, 334.9, 334.12, 334.14, 334.15, 334.19, 334.23, 334.24, 334.25, 334.26, 334.27, 334.32, 330.1

[56] References Cited

U.S. PATENT DOCUMENTS

| | | | |
|---|---|---|---|
| 4,552,415 | 11/1985 | Fulterer | 312/330.1 X |
| 5,147,123 | 9/1992 | Berger | 312/348.1 |
| 5,161,869 | 11/1992 | Albiez | 312/348.1 |
| 5,180,217 | 1/1993 | Lautenschlager | 312/330.1 X |
| 5,452,952 | 9/1995 | Grabher | 312/348.1 |
| 5,462,349 | 10/1995 | Grabher | 312/348.2 X |

FOREIGN PATENT DOCUMENTS

| | | | |
|---|---|---|---|
| 281766 | 9/1988 | European Pat. Off. | 312/348.1 |
| 0 429 428 | 5/1991 | European Pat. Off. . | |
| 567789 | 11/1993 | European Pat. Off. | 312/348.1 |
| 27 02 217 | 7/1978 | Germany . | |
| 34 27 230 | 2/1985 | Germany . | |
| 39 34 419 | 4/1991 | Germany . | |
| 91 13 477.3 | 8/1992 | Germany . | |
| 4242717 | 7/1993 | Germany | 312/334.6 |
| 93 03 903.4 | 5/1994 | Germany . | |
| 2169491 | 7/1986 | United Kingdom | 312/348.1 |

*Primary Examiner*—Milton Nelson, Jr.
*Assistant Examiner*—Rodney B. White
*Attorney, Agent, or Firm*—Wenderoth, Lind & Ponack

[57] ABSTRACT

A metal pull-out rail is to be connected to a drawer bottom plate and to a drawer side wall having a cover strip to cover a lateral edge of the bottom plate. The pull-out rail includes a lower horizontal flange on which is to be positioned the bottom plate. A plurality of flaps integral with the flange are punched from the material thereof. A portion of each flap is inclined to the flange in a direction to be away from the bottom plate. Each flap has a free end and a portion having therethrough a hole for receipt of a screw for attaching the flap to the bottom plate. Each flap has an abutting portion for, when the flap is attached to the bottom plate by the respective screw fitting through the hole and being screwed into the bottom plate to thereby move the portion toward the bottom plate, abutting the bottom plate and causing the bottom plate to be urged toward the cover strip.

20 Claims, 3 Drawing Sheets

DRAWER

FIELD AND BACKGROUND OF THE INVENTION

The invention relates to a metal pull-out rail to be connected to a drawer bottom plate and to a drawer side wall having a cover strip to cover a lateral edge of the bottom plate, the pull-out rail including a lower horizontal flange on which is to be positioned the bottom plate, and a plurality of flaps integral with said flange and punched from the material thereof. Further, the invention relates to a drawer assembly and to a drawer employing such pull-out rail.

Generally, a pull-out rail of a pull-out assembly is attached to a side wall of a drawer. Such rails have L-, U- or Z-shaped profiles. Such rails can be separate rails or integral parts of the drawer side walls.

DE-OS 27 02 217 and EP-A2-0 429 428 show drawers with metal side walls, whereby the side walls have Z-shaped profiles including the upper horizontal flanges that are utilized as runner flanges for roller bearings mounted on furniture side walls. In this way, the drawer does not need separate pull-out rails. Lower horizontal flanges of the side walls have hooks which protrude into openings such as grooves in the drawer bottom plate.

German utility model 9113477 shows a drawer side wall made of steel and having a cover strip above the flange on which the bottom plate rests, such cover strip covering the lateral edge of the bottom plate.

DE-A1-39 34 419 and German utility model 9303903 each show a drawer side wall consisting of a lower part and an upper part. The lower part includes a horizontal flange on which the bottom plate rests and the upper part includes a cover strip. The two parts are welded together.

Bottom plates are not always of exactly the same thickness. As a consequence, the space between the lower horizontal flange of the drawer side wall and the cover strip is chosen to be slightly larger than actually necessary so that a range of tolerance regarding the thickness of the bottom plate to be mounted is obtained. Therefore, it may happen that, when the bottom plate is inserted, there is a clearance between the bottom plate and the cover strip. Dirt particles can easily accumulate in such a clearance. Especially in the case of kitchen furniture, this should be avoided.

SUMMARY OF THE INVENTION

It is an object of the invention to provide an improved metal pull-out rail of the above described type, wherein an anchoring between the bottom plate and the drawer side walls is improved in such a way that the bottom plate always abuts the cover strips of the drawer side walls.

According to the invention, this object is achieved by each flap having a free end portion having therethrough a hole for receipt of a screw for attaching the flap to the bottom plate. Each flap has an abutting portion, between the hole and an opposite end of the flap, for, when the flap is attached to the bottom plate by the respective screw fitting through the hole and being screwed into the bottom plate to thereby move the abutting portion toward the bottom plate, abutting the bottom plate and causing the bottom plate to be urged toward the cover strip.

BRIEF DESCRIPTION OF THE DRAWINGS

In the following an embodiment of the invention will be described in more detail with reference to the accompanying drawings in which.

DESCRIPTION OF THE PREFERRED EMBODIMENT

Figure 1:
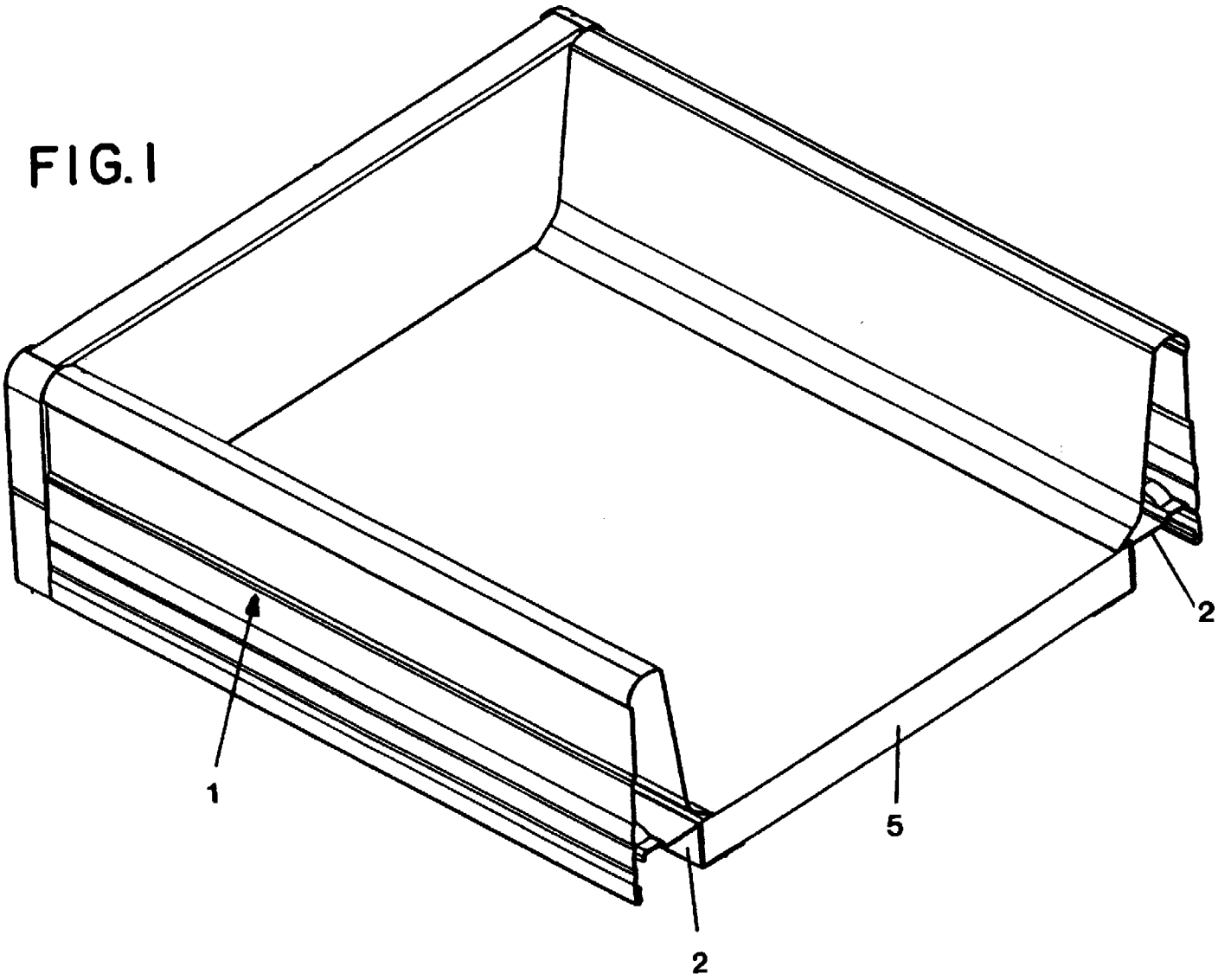
FIG. 1 is a perspective view of a drawer.
Figure 4:
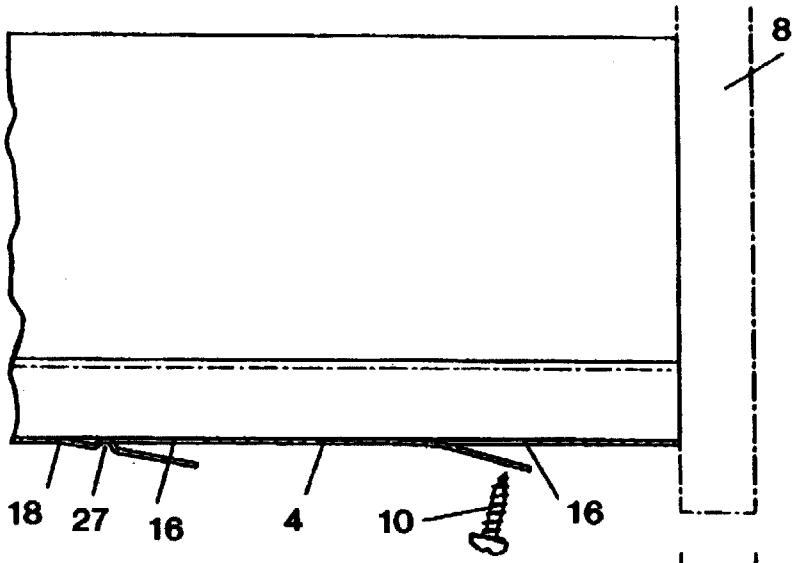
FIG. 4 is a longitudinal section of the same area of the drawer before the screw is fastened.

A pull-out rail 2 of a drawer guide assembly is inserted into a side wall 1 of a drawer. The pull-out rail 2 has a vertical web 3 which is connected to an outer wall 1' of the drawer side wall 1. The pull-out rail 2 further has a horizontal flange 4, which carries a bottom plate 5 of the drawer. An inner wall 1" of the drawer side wall 1 includes a cover strip 6 which covers the lateral edge of the bottom plate 5. Mounted on the pull-out rail 2 are rollers 7 which are guided on a horizontal flange 8 of a support rail 11 mounted on side wall 32 of a cabinet. At the front end of the support rail 11 is mounted a roller 9.

As can be seen in FIGS. 2 to 10, flaps 12, 13, 14 and/or 15 are punched out of the material of horizontal flange 4 of the pull-out rail 2. The flaps 12, 13, 14, 15 are situated in punch holes 16 of the horizontal flange 4 of the pull-out rail 2. The punch holes 16 define the edges of the flaps 12, 13, 14, 15.

When assembling the drawer, the bottom plate 5 is placed on the horizontal flanges 4 of the pull-out rails 2 or the drawer parts are reversed and the pull-out rails 2 are placed on the bottom side of the bottom plate 5. The flaps 12, 13, 14, 15 are used for rigidly connecting the bottom plate 5 and the pull-out rails 2 by means of screws 10. The screws 10 extend through holes 17 in the flaps 12, 13, 14, 15. The inventive form of the flaps 12, 13, 14, 15 prevents a clearance from existing between the bottom plate 5 and the cover strip 6 when the bottom plate 5 is mounted on the pull-out rails 2.

To prevent a gap from remaining between the bottom plate 5 and the cover strip 6 when the bottom plate 5 is thinner than the distance between the horizontal flange 4 and the cover strip 6, the flaps 12, 13, 14, 15 are bendable in such a way that they have an abutting portion 27 which abuts the bottom plate 5 and presses the bottom plate 5 toward and against the cover strip 6. Bending of the flaps 12, 13, 14, 15 occurs when the screws 10 are screwed into the bottom plate 5.

To ensure the bending of the flaps 12, 13, 14, 15 the flaps 12, 13, 14, 15 are provided with an area of reduced cross section between their connection 18 with the horizontal flange 4 and the hole 17 for the screws 10. This area of reduced cross section will give way when the screw 10 is screwed into the bottom plate 5 and will cause the flaps 12, 13, 14, 15 to buckle or bend. Such an area of reduced cross section can be achieved in different ways.

Figure 5:
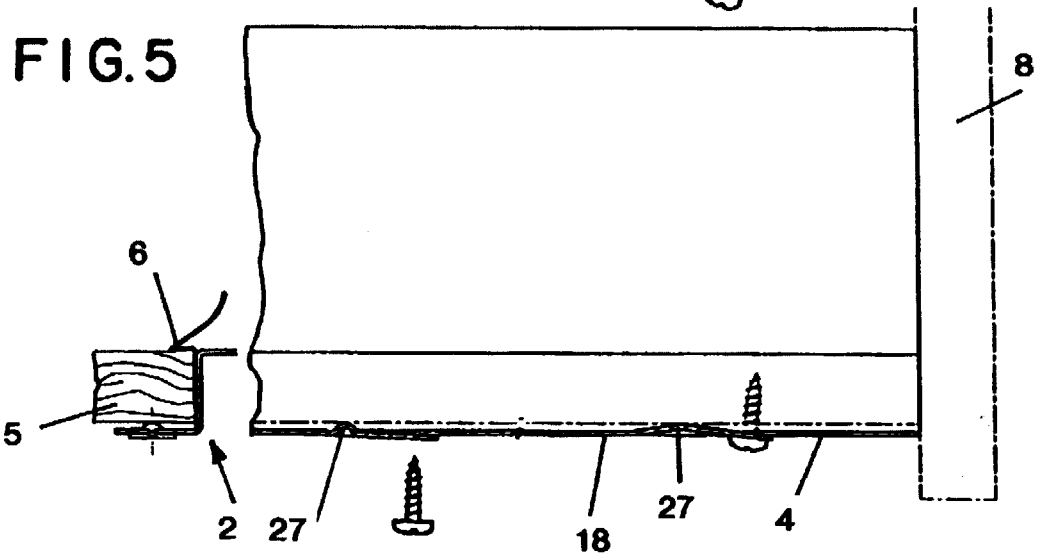
FIG. 5 is a longitudinal section of such area of the side wall and the bottom plate after fastening of the screw.
Figure 2:
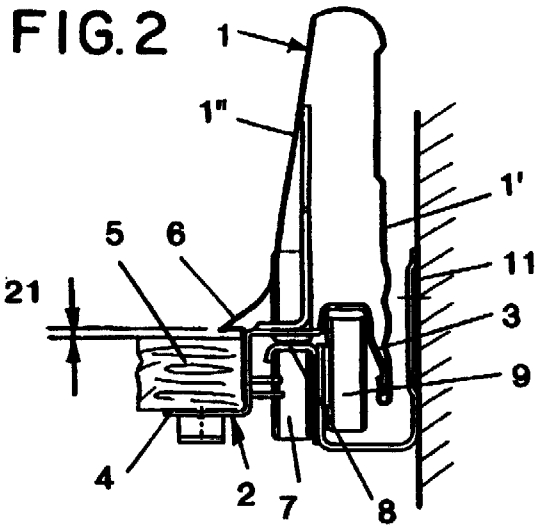
FIG. 2 is a cross section of a drawer side wall and a bottom plate in the region of a flap before a screw is fastened.
Figure 3:
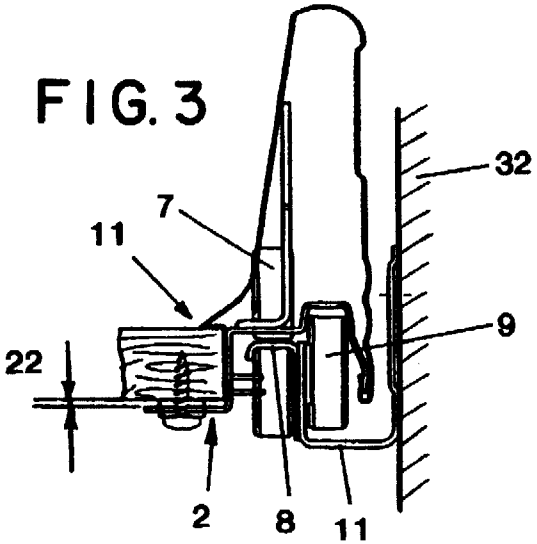
FIG. 3 is a cross section of the drawer side wall and the bottom plate after fastening the screw.
Figure 6:
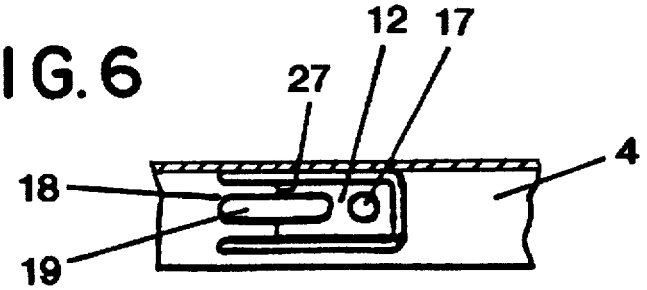
FIGS. 6 to 9 each is a view of a lower horizontal flange seen from below, with a respective flap.
Figure 10:
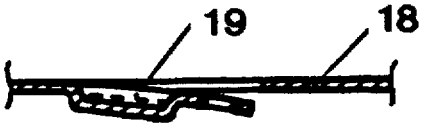
FIG. 10 is a longitudinal cross section of the flange of FIG. 6.

In the embodiment of FIGS. 6 and 10 the flap 12 is provided with a longitudinal recess 19. Because of the recess 19 the flap 12 will bend or buckle when it is fastened to the bottom plate 5 by means of the screw 10. As can be seen in FIGS. 3 and 5, because of bending of flap 12 the bottom plate 5 will be urged toward the cover strip 6 of the drawer side wall 1. Instead of a gap 21, between the cover strip 6 and the bottom plate (FIGS. 2 and 4), there will be a gap 22 between the bottom plate 5 and the horizontal flange 4 (FIGS. 3 and 5). This gap 22 however is not seen by the person using the drawer.

Figure 7:
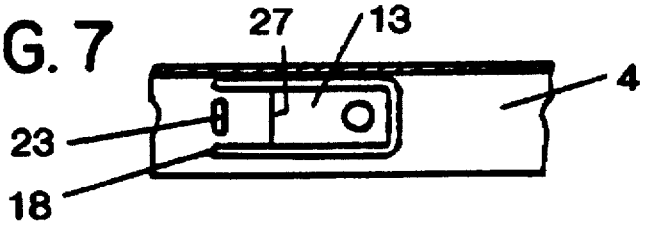

In the embodiment of FIG. 7 the flap 13 is, in the area 18 of connection with the horizontal flange 4, provided with a slot 23. This slot 23 results in the necessary reduction of the cross-sectional area of the flaps 13 which again will cause the flap 13 to bend with the abutting portion 27 being pressed against and raising bottom plate 5 when the free front end of the flap is screwed onto the bottom plate 5.

Figure 8:
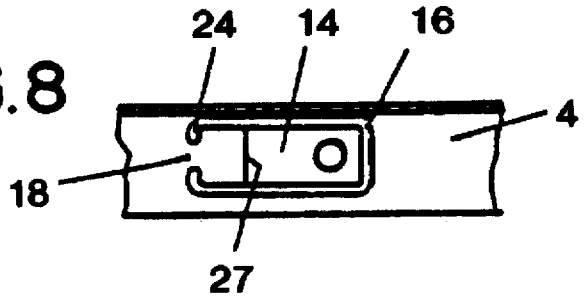
Figure 9:
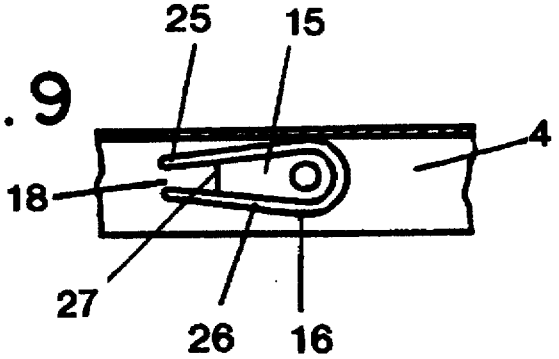

In the embodiments of the FIGS. 8 and 9 the ends 24, 25 of the edges 26 of the flaps 14, 15 converge toward each other. In the embodiment of FIG. 8 ends 24 are at an angle of approximately 90° with respect to the edges 26. In the embodiment of FIG. 9 the edges 26 are inclined to each other and converge to ends 25.

To intensify the bending of the flaps 12, 13, 14, 15, abutting portion 27 may be delimited or formed by a memory retentive portion which is directed transverse to each flap 12, 13, 14, 15. Such memory retentive portion may be a corrugation or inverted U-shaped bulge (left flap in FIGS. 4 and 5), or a crease (FIGS. 6–9), or an upward bulge (right flap in FIGS. 4 and 5).

Thus, each flap has one end that is integral with flange 4. The area of connection 18 of such one flap end is of reduced cross section to facilitate bending of the flap. Each flap also has an opposite free end having therethrough a screw-receiving hole 17. Between such ends, and specifically between the area of reduced cross section and the hole 17, is located the abutting portion 27. Upon screw 10 being extended through hole 17 and being screwed into bottom plate 5, the flap is bent upwardly at the area of reduced cross section thereof. This upward movement of the flap causes abutting portion 27 to lift bottom plate 5 upwardly toward cover strip 6.

We claim:

1. A metal pull-out rail to be connected to a drawer bottom plate and to a drawer side wall having a cover strip to cover a lateral edge of the bottom plate, said pull-out rail comprising:

a lower horizontal flange on which is to be positioned the bottom plate;

a plurality of flaps integral with said flange and punched from the material thereof;

each said flap having a first end integral with said flange in an area of connection thereto;

each said flap having a free second end opposite from said first end, said free second end having therethrough a hole to receive a screw for attachment of said flap to the bottom plate; and each said flap having, at a location between said first and second ends thereof, an abutting portion operable, upon the screw being fit through said hole and being screwed into the bottom plate, to be moved toward and into abutment with the bottom plate to lift and urge the bottom plate toward the cover strip.

2. A pull-out rail as claimed in claim 1, wherein said area of connection of said first end of said flap is of reduced cross section.

3. A pull-out rail as claimed in claim 2, wherein said abutting portion is located between said reduced cross section and said hole.

4. A pull-out rail as claimed in claim 3, wherein said abutting portion extends upwardly above a plane of said flap.

5. A pull-out rail as claimed in claim 3, wherein said abutting portion comprises a memory retentive portion formed in said flap.

6. A pull-out rail as claimed in claim 5, wherein said memory retentive portion comprises an inverted U-shaped corrugation extending upwardly from said flap.

7. A pull-out rail as claimed in claim 5, wherein said memory retentive portion comprises a crease formed in said flap.

8. A pull-out rail as claimed in claim 5, wherein said memory retentive portion comprises an upward bulge in said flap.

9. A pull-out rail as claimed in claim 3, wherein said abutting portion extends entirely transversely across said flap.

10. A pull-out rail as claimed in claim 2, wherein said reduced cross section area has a hole therein.

11. A pull-out rail as claimed in claim 2, wherein edges of said flap are directed toward each other at said area of connection, thus forming said reduced cross section.

12. A pull-out rail as claimed in claim 2, wherein edges of said flap converge toward said first end thereof.

13. A pull-out rail as claimed in claim 1, wherein said flap is inclined to said flange in a direction to be away from the bottom plate.

14. A drawer assembly comprising:

a drawer side wall having a cover strip;

a metal pull-out rail rigid with said side wall, said rail having a lower horizontal flange on which is to be positioned a drawer bottom plate, whereby said cover strip would cover a lateral edge of the bottom plate;

a plurality of flaps integral with said flange and punched from the material thereof;

each said flap having a first end integral with said flange in an area of connection thereto;

each said flap having a free second end opposite from said first end, said free second end having therethrough a hole to receive a screw for attachment of said flap to the bottom plate; and each said flap having, at a location between said first and second ends thereof, an abutting portion operable, upon the screw being fit through said hole and being screwed into the bottom plate, to be moved toward and into abutment with the bottom plate to lift and urge the bottom plate toward said cover strip.

15. A drawer assembly as claimed in claim 14, wherein said area of connection of said first end of said flap is of reduced cross section.

16. A drawer assembly as claimed in claim 15, wherein said abutting portion is located between said reduced cross section and said hole.

17. A drawer assembly as claimed in claim 14, wherein said flap is inclined to said flange in a direction to be away from the bottom plate.

18. A drawer assembly comprising:

a drawer side wall having a cover strip;

a metal pull-out rail rigid with said side wall, said rail having a lower horizontal flange;

a drawer bottom plate supported on said flange with a lateral edge of said bottom plate being covered by said cover strip;

a plurality of flaps integral with said flange and punched from the material thereof;

each said flap having a first end integral with said flange in an area of connection thereto;

each said flap having a free second end opposite from said first end, said free second end having therethrough a hole;

a respective screw inserted through each said hole and screwed into said bottom plate to attach the respective said flap thereto; and each said flap having, at a location between said first and second ends thereof, an abutting portion urged by said respective screw fitting through said hole and being screwed into said bottom plate to abut said bottom plate and to lift said bottom plate toward said cover strip.

19. A drawer assembly as claimed in claim 18, wherein said area of connection of said first end of said flap is of reduced cross section.

20. A drawer assembly as claimed in claim 19, wherein said abutting portion is located between said reduced cross section and said hole.

* * * * *